US006959645B2

(12) United States Patent
Ruoff

(10) Patent No.: US 6,959,645 B2
(45) Date of Patent: Nov. 1, 2005

(54) PRINTING PRESS FOR PROCESSING CONTINUOUS WEBS

(75) Inventor: Wolfgang Ruoff, Lörrach (DE)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 10/448,659

(22) Filed: May 29, 2003

(65) Prior Publication Data

US 2003/0230206 A1 Dec. 18, 2003

(30) Foreign Application Priority Data

Jun. 12, 2002 (EP) ..... 02405481

(51) Int. Cl.[7] ..... B41F 5/00
(52) U.S. Cl. ..... 101/480; 101/479; 74/393
(58) Field of Search ..... 101/479, 480; 74/354, 393

(56) References Cited

U.S. PATENT DOCUMENTS 1,018,617 A * 2/1912 Huffman ..... 101/228
3,051,012 A * 8/1962 Sato ..... 74/354
3,564,935 A * 2/1971 Vigneri ..... 74/354
3,611,924 A * 10/1971 Harrison ..... 101/98
3,713,420 A * 1/1973 Pfaffle ..... 118/212
3,938,437 A * 2/1976 Punater ..... 101/228
4,887,531 A * 12/1989 Ichikawa et al. ..... 101/216

FOREIGN PATENT DOCUMENTS

EP 1132204 9/2001
FR 1445050 6/1965

* cited by examiner

*Primary Examiner*—Andrew H. Hirshfeld
*Assistant Examiner*—Jill E. Culler
(74) *Attorney, Agent, or Firm*—Friedrich Kueffner

(57) ABSTRACT

A printing press for processing continuous webs has a machine frame and printing cylinders exchangeably mounted in the machine frame. A drive is provided. An inking system is mounted in the machine frame. The drive has a two-row gear wheel having a first toothing and a second toothing, wherein the first toothing has an inch-based division and the second toothing has a metric division. The printing cylinders are driven by the first toothing for printing an inch-based size and the printing cylinders are driven by the second toothing for printing a metric size.

11 Claims, 2 Drawing Sheets

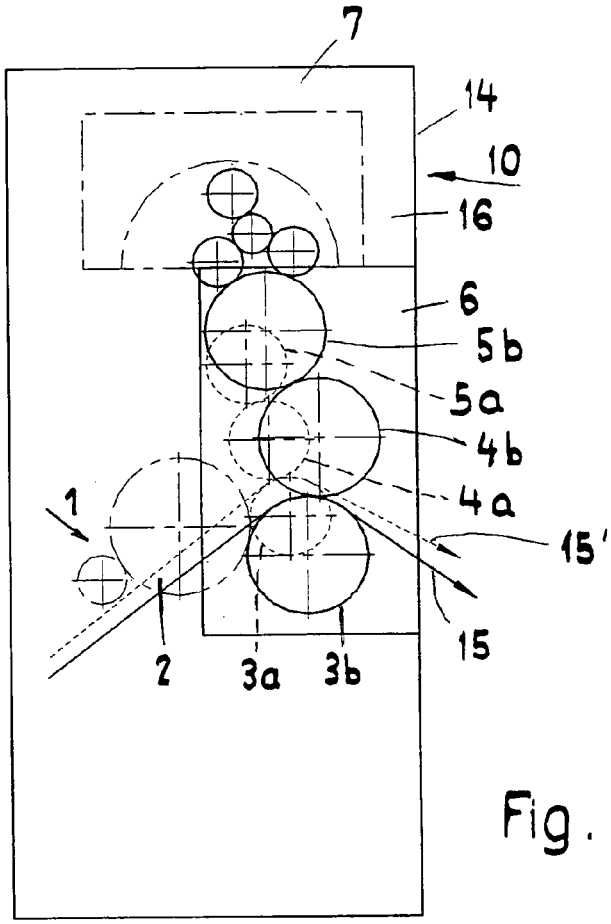
Fig. 1
Fig. 2
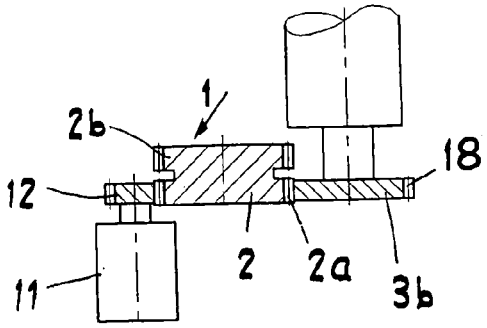
Fig. 3
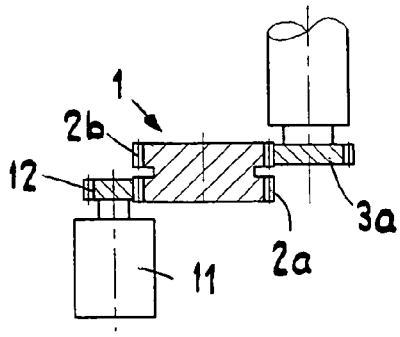

PRINTING PRESS FOR PROCESSING CONTINUOUS WEBS

BACKGROUND OF THE INVENTION

1. Field of the Invention

The invention relates to a printing press for processing continuous webs, comprising a machine frame, exchangeable printing cylinders, a drive, and an inking system.

2. Description of the Related Art

A printing press of the aforementioned kind is known in the prior art from EP 1 132 204 A1 of the assignee. With this printing press, continuous products can be produced with high quality and output, for example, by a rotary offset process. When the press is configured, as is most common, for inch-based sizes, exact metric sizes can be produced in that a strip is cut from an inch-based size. For example, with such a press two DIN-A4 sizes can be produced exactly by cutting off a strip of 15.6 cm from the 24 inch size. When converted to a different format, a high volume of paper waste is to be expected in the case of this printing press and the waste is expensive to dispose of. The paper webs to be printed are not optimally used in one of the two sizes.

It is also known to adjust a printing press to other sizes by means of gear and cylinder corrections. After such a conversion, further processing in the same machine is not possible. For this purpose, the speed of all draw rollers and counter rollers would have to be adjusted also; this is possible in the case of rollers mounted to be stationary only when they have an adjustable drive. As an alternative, the diameter of the rollers could be changed while the roller speed remains the same.

SUMMARY OF THE INVENTION

It is an object of the present invention to provide a continuous printing press of the aforementioned kind which enables exact printing of inch-based sizes as well as millimeter-based sizes. Further processing should be possible and paper waste should be avoided.

In accordance with the present invention, this is achieved in that the drive has a two-row gear wheel with a first toothing and a second toothing wherein the first toothing has a division in inches and the second toothing has a metric division and wherein the printing cylinders are driven by the first toothing for printing an inch-based size and driven by the second toothing for printing a metric size.

The invention is based on the recognition that different inch-based sizes provide exact metric section lengths. For example, these are the sizes 20 inch, 25 inch, 30 inch, 35 inch, and 40 inch. Particularly suitable is the 30 inch size because in this case particularly useful divisions and tooth modules result. In the case of a two-row planet wheel with 30 inch circumference, a tooth division of 6 mm results. With such an inch-based size the following important DIN sizes can be produced:

630 mm:6 mm=105 teeth (standard headset size)

594 mm:6 mm=99 teeth (exactly two times DIN A4-297 mm)

420 mm:6 mm=70 teeth (exactly DIN A3)

In this way, a continuous printing press according to the invention provides at least an option for the other size. Even when such a press is used only for inch-based sizes, the basic expense is only insignificantly higher than for a press without this option.

The two-row gear wheel can be arranged in a plug-in unit. The printing group can then be configured substantially as is conventional. Only the plug-in unit would have to be matched. Preferably, the two-row gear wheel however is arranged in the printing group; this provides a particularly compact configuration. Preferably, the gear wheel is a planet wheel.

According to a further embodiment of the invention, the printing cylinders are arranged in a plug-in unit. The plug-in unit can be exchanged simply for changing the printing lengths. An exchange from one printing size to another is thus possible in a particularly simple and fast way.

According to another embodiment of the invention, it is provided that the two-row gear wheel meshes with a two-row intermediate gear wheel which has the same reference diameter in both planes. With such an intermediate gear wheel, additional metric divisions are possible. By providing additional intermediate gear wheels in the drive train, additional divisions can be realized. For example, a printing length of 400 mm is not possible with a division of 6 mm because the resulting tooth number is not an integer. Almost any desired gear wheel combination can be used. The circumference must only enable a 6 mm division and the additional desired tooth divisions. When converting from 6 mm to 10 mm, all multiples of 30 mm are theoretically possible.

BRIEF DESCRIPTION OF THE DRAWING

In the drawings:

FIG. 1 is a schematic view of a continuous printing press according to the invention;

FIG. 2 is a schematic partial section of the drive of the continuous printing press according to FIG. 1;

FIG. 3 is an illustration according to FIG. 2 after conversion to a different size;

DESCRIPTION OF THE PREFERRED EMBODIMENTS

Figure 4:
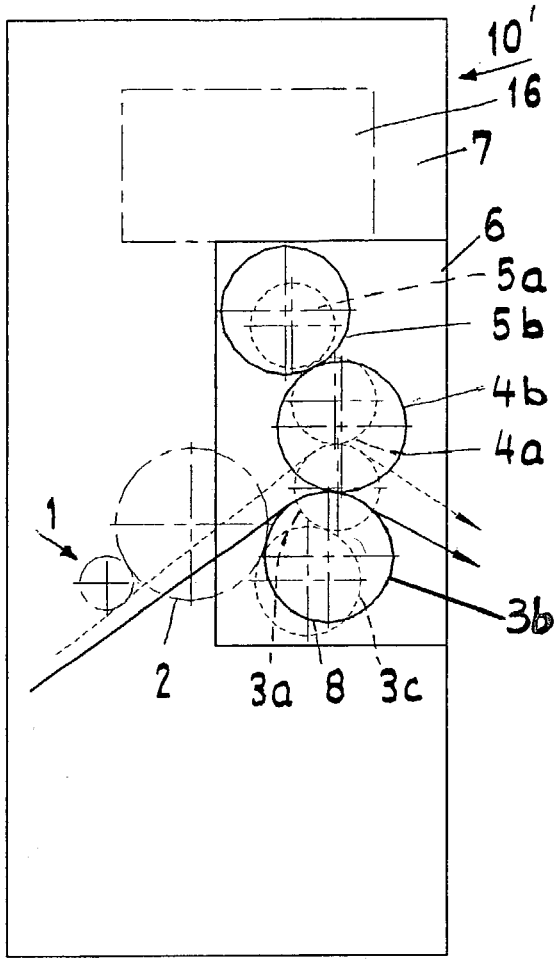
FIG. 4 is a schematic view of a continuous printing press according to the invention according to another embodiment.

The printing press 10 illustrated in FIG. 1 is a continuous printing press and comprises a printing group 14 and a machine frame 7 in which a drive 1 as well as an inking system 16, illustrated in dashed lines, are mounted. A plug-in unit 6 comprises a counter cylinder 3*b*, a transfer cylinder 4*b*, and a plate cylinder 5*b* for inch-based sizes. For metric sizes, the plug-in unit 6 is provided with a counter cylinder 3*a*, a transfer cylinder 4*a*, as well as a plate cylinder 5*a*. These cylinders 3*a*, 4*a*, 5*a* are illustrated in dashed lines. When inch-based sizes are printed, the plug-in unit 6 is provided with the cylinders 3*b*, 4*b*, and 5*b*. When metric sizes are to be printed, the plug-in unit 6 is exchanged for a plug-in unit that comprises the printing cylinder 3*a*, 4*a*, 5*a*. The exchange of plug-in units 6 can be realized, as is known in the art, by means of rail systems or lifting vehicles.

The inking system 16, which is of a known configuration, is illustrated only schematically by rollers 17 with which the ink is transferred onto the plug-in unit 6. Preferably, the rollers 17 of the inking system 16 are driven directly by the plug-in unit 6. Generally, the drive action of the rollers 17 is realized by means of the plate cylinders 5*a* and 5*b*. In the inking system 16, the driven rollers 17 must rotate approximately at the same circumferential speed as the cylinders 3*a*, 4*a*, 5*a* or 3*b*, 4*b*, 5*b* of the plug-in units 6. Relative speeds cause friction, heat, and wear on the rollers and cylinders. The speeds, however, must coincide only in approximation because the inking system 16 generally is configured such that one driven steel roller always rolls together with a non-driven rubber roller. The rubber roller is driven only by means of its surface wherein there is always slip of approximately 1–2%. Small deviations in the circumferential speeds of the driven rollers are thus permissible.

A continuous web 15, shown only as a section, is printed which, when producing inch-based sizes, runs between the transfer cylinder 4*b* and the counter cylinder 3*b*. When manufacturing metric sizes, the continuous paper web 15' runs between the counter cylinder 3*a* and the transfer cylinder 4*a*. When changing the size, the plug-in unit 6 is exchanged; this is comparatively simple and can be carried out quickly. Such a size change basically does not differ from that of a printing press designed only for inch-based sizes.

The drive of the printing cylinders 3*a*, 4*a*, 5*a* or 3*b*, 4*b*, 5*b* is realized by a drive device 1 which, according to FIG. 2, has a motor 11 or another drive means. The motor 11 has a gear wheel 12 which meshes with a first toothing 2*a* of a two-row planet wheel 2. The gear wheel 12 can also mesh with the toothing 2*b*. The counter cylinder 3*b* is driven by this first toothing 2*a* which meshes with a gear wheel 18 connected to the counter cylinder 3*b*. The planet wheel 2 has a second toothing 2*b* which has the same reference diameter as the toothing 2*a*; however, this is not mandatory in all cases. Both toothings 2*a* and 2*b* are fixedly connected to one another.

It is important in this connection that the toothings 2*a* and 2*b* are different; the toothing 2*a* has an inch-based division and the toothing 2*b* has a metric division. The two toothings 2*a* and 2*b* have, for example, a circumference of 30 inches which corresponds exactly to a circumference of 762 mm. In principle, other sizes are also possible, for example, 20 inches, 25 inches, 35 inches, and 40 inches, as well as other multiples of 5 inches. For a circumference of 30 inches, a tooth division of 6 mm results. The most important DIN sizes can be produced with this size. Also, it is possible to produce all other sizes having a multiple of 6 mm. Other tooth divisions are also possible, in particular, 4 mm, 5 mm, and 8 mm for the second toothing 2*b* and ¼ inch, ⅙ inch or ⅓ inch for the first toothing 2*a*.

In the arrangement according to FIG. 2, an inch-based paper size is printed. When it is desired to print an exact metric paper size, the plug-in unit 6, as explained above, is exchanged for a plug-in unit having printing rollers 3*a*, 4*a*, 5*a*. The counter cylinder 3*a* is arranged such that it is driven by the toothing 2*b* which has a metric division, as explained above. In the printing press 10 the drive acts on the counter cylinders 3*a* or 3*b*. The drive can also act on the plate cylinders 5*a* or 5*b*.

Figure 5:
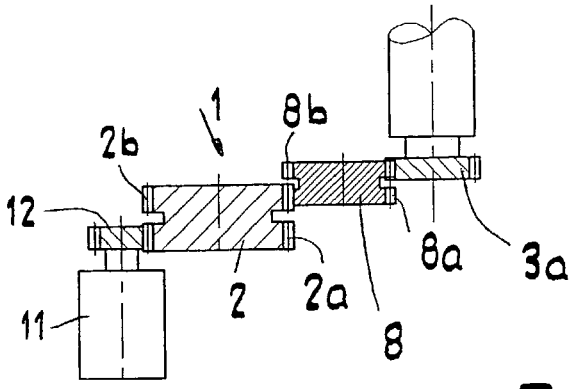
FIG. 5 is a partial section of the drive of the continuous printing press according to FIG. 4.

The printing press 10' shown in FIGS. 4 and 5 differs from the press 10 by an intermediate gear wheel 8 which is also of a two-row configuration and has a first intermediate toothing 8*a* and a second intermediate toothing 8*b*. These toothings 8*a* and 8*b* are also fixedly connected to another and have the same reference diameter. The intermediate wheel 8 enables additional metric divisions. For example, when a printing length of 400 mm is to be produced, this is not possible with a tooth division of 6 mm because this does not provide a tooth number that is an integer. By means of the intermediate wheel 8 such a printing length is however possible. The toothing 8*a*, for example, has a 6 mm division and 40 teeth so that this results in a circumference of 240 m. The toothing 8*b* has a 10 mm metric division and 24 teeth so that this also results exactly in a circumference of 240 mm. Other tooth combinations are also possible. The circumference of the toothing however must always allow for a 6 mm division and the additionally desired tooth division. When converting from 6 mm to 10 mm, theoretically any multiple of 30 mm is possible. Thirty is the smallest common denominator of 6 and 10.

In the described embodiments, the inking system 16 is driven by the plug-in unit 6. However, conceivable is also a configuration in which the inking system 16 is driven by its own drive, not illustrated. The drive 1 only drives the plug-in unit 6. In this case, it is also possible that the reference diameters of the two-row toothings 2*a* and 2*b* of the two-row gear wheel 2 are different.

The gear wheel 2 can be configured essentially as desired when the rotary speed of the motor 11 is matched accordingly. This is possible generally in a simple way by means of servo drives by changing the transmission ratio. By means of coding or by means of manual input it is possible to recognize whether the plug-in unit 6 is designed for inch-based paper sizes or metric paper sizes, and the drive 1 is controlled accordingly. It is thus possible that one revolution of the motor 11 for an inch-based plug-in unit is, for example, 6 inches while for a metric plug-in unit it is 5.75 inches; this is dependent on the transmission ratio in the gear wheel 2. The gear wheel 2 in the shown embodiment is a unitary or monolithic part. However, as an alternative, it can comprise a shaft onto which two annular toothings are mounted and keyed to the shaft for common rotation. One toothing is provided with an inch division and the other toothing is provided with a metric division.

For driving the plug-in unit, the following situations are thus conceivable:

a) The drive action is realized by means of a gearbox and a longitudinal shaft on the counter cylinder 3*a* or 3*b*. In this case, the reference diameters of the two toothings 2*a* and 2*b* of the two-row gear wheel 2 are identical. The reference diameter is preferably 30 inches.

b) The drive action is realized by means of a servo drive which acts on the counter cylinder 3*a* or 3*c* wherein no additional draw roller is provided. In this case, the reference diameter of the two toothings 2*a* and 2*b* can be different because the rotary speed of the servo drive is variable.

c) When the drive according to b) is provided with a servo drive and an additional draw roller is provided, the reference diameter of the two toothings 2*a* and 2*b* must also be identical.

d) The plug-in unit 6 is driven via a gearbox by the inking system 16. There is only one interface between the inking system 16 and the plug-in unit 6. This interface has a two-row gear wheel 2 and is thus provided with two rows of teeth. The drive in this case has only one rotary speed because the speed of the inking system 16 is always identical. The reference diameter of the toothings 2*a* and 2*b* must be selected to be exactly identical because otherwise the printing image would slowly move.

e) The drive is realized by means of the inking system 16 acting on the plug-in unit 6 with a servo drive. The interface between the inking system 16 and the plug-in unit 6 also has a two-row gear wheel 2. The rotary speed of the servo drive can be corrected minimally in order to compensate small driving errors. The servo drive must be adjusted such that the sizing parts run correctly according to the printing cycling. The inking system 16 can rotate accordingly with a small relative speed.

In the aforementioned situations, in the transfer of the plate cylinders 5*a* and 5*b* to the inking system 16 the two toothings 2*a* and 2*b* have essentially the same reference diameters so that no relative speed results within the inking system 16.

While specific embodiments of the invention have been shown and described in detail to illustrate the inventive principles, it will be understood that the invention may be embodied otherwise without departing from such principles.

What is claimed is:

1. A printing press for processing continuous webs, comprising:

a machine frame;

printing cylinders exchangeably mounted in the machine frame;

a drive;

an inking system mounted in the machine frame;

wherein the drive comprises a two-row gear wheel having a first gear wheel with a first toothing and a second gear wheel with a second toothing, wherein the first toothing has an inch-based division and the second toothing has a metric division; and wherein the printing cylinders are driven by the first toothing for printing an inch-based size and the printing cylinders are driven by the second toothing for printing a metric size.

2. The printing press according to claim 1, wherein the printing cylinders are combined to a plug-in unit that is exchangeable, wherein the two-row gear wheel is arranged between a drive member of the drive and one of the printing cylinders of the plug-in unit.

3. The printing press according to claim 2, wherein the two-row gear wheel is arranged in the plug-in unit.

4. The printing press according to claim 1, wherein the two-row gear wheel is arranged on the machine frame.

5. The printing press according to claim 1, wherein the second toothing has a division of 4 mm, 5 mm, 6 mm, or 8 mm.

6. The printing press according to claim 1, wherein the first toothing has a division of ¼ inch (6.35 mm) or ⅙ inch or ⅓ inch.

7. The printing press according to claim 6, wherein the drive comprises a two-row intermediate gear wheel meshing with the two-row gear wheel, wherein the intermediate gear wheel has first and second intermediate toothings having an identical reference diameter.

8. The printing press according to claim 1, wherein the two-row gear wheel has a reference circumference that is a multiple of five inches.

9. The printing press according to claim 8, wherein the reference circumference is 30 inches.

10. The printing press according to claim 1, wherein the first and second toothings have an identical reference diameter.

11. The printing press according to claim 1, wherein the printing cylinders are combined to a plug-in unit that is exchangeable, wherein the plug-in unit and the inking system are connected by the two-row gear wheel and wherein the first and second toothings have an identical reference diameter.

* * * * *